United States Patent [19]

Roser et al.

[11] Patent Number: 4,669,677

[45] Date of Patent: Jun. 2, 1987

[54] YARN STORAGE AND DELIVERY ARRANGEMENT, PARTICULARLY FOR TEXTILE MACHINES

[75] Inventors: Erich Roser, Bermatingen; Gustav Memminger, Heideweg 65, D-7290 Freudenstadt, both of Fed. Rep. of Germany

[73] Assignee: Gustav Memminger, Freudenstadt, Fed. Rep. of Germany

[21] Appl. No.: 785,475

[22] Filed: Oct. 8, 1985

[30] Foreign Application Priority Data

Oct. 11, 1984 [DE] Fed. Rep. of Germany ..... 3437252

[51] Int. Cl.[4] ..... B65H 51/22

[52] U.S. Cl. ..... 242/47.01

[58] Field of Search ..... 242/47.01, 47.02, 47.03, 242/47.04, 47.05, 47.06, 47.07, 47.08, 47.09, 47.1, 47.11, 47.12, 47.13; 66/132 R, 132 T; 139/452; 226/190, 191, 193, 194

[56] References Cited

U.S. PATENT DOCUMENTS

| | | | |
|---|---|---|---|
| 3,419,225 | 12/1968 | Rosen | 242/47.12 |
| 3,924,818 | 12/1975 | Pfeifle | 242/47.12 X |
| 3,955,769 | 5/1976 | Kajiura et al. | 242/47.01 |
| 4,121,782 | 10/1978 | Shelton | 242/47.12 |
| 4,238,080 | 12/1980 | Van Mullekom | 242/47.12 |
| 4,271,687 | 6/1981 | Memminger et al. | 242/47.01 X |
| 4,349,161 | 9/1982 | Carlsson et al. | 242/47.01 |
| 4,476,904 | 10/1984 | Ito et al. | 242/47.01 X |
| 4,498,639 | 2/1985 | Deborde et al. | 242/47.01 |

FOREIGN PATENT DOCUMENTS

| | | | |
|---|---|---|---|
| 210717 | 3/1981 | Czechoslovakia . | |
| 213493 | 9/1981 | Czechoslovakia . | |
| 1785508 | 4/1971 | Fed. Rep. of Germany . | |
| 2436936 | 2/1975 | Fed. Rep. of Germany . | |
| 2723210 | 12/1977 | Fed. Rep. of Germany . | |
| 3104516 | 12/1981 | Fed. Rep. of Germany . | |
| 3203223 | 8/1982 | Fed. Rep. of Germany . | |
| 3429219 | 2/1986 | Fed. Rep. of Germany . | |
| 100296 | 9/1973 | German Democratic Rep. . | |
| 2027456 | 2/1980 | United Kingdom . | |
| 2069016 | 8/1981 | United Kingdom | 242/47.01 |

*Primary Examiner*—Stanley N. Gilreath

*Attorney, Agent, or Firm*—Frishauf, Holtz, Goodman & Woodward

[57] ABSTRACT

A yarn storage and delivery arrangement, particularly for textile machines, has a storage drum (4) that has a number of elongated yarn support elements (12) arranged evenly around the circumference at equal radial distances from the drum axis; and having yarn storage contact sections (13) to store several loops or turns of a storage winding. To achieve a simple, low-inertia design of the storage drum, the yarn support elements (12) are formed by U or L-shaped narrow bails or wire elements fastened at least at one end to the drum body (5) and guided at the other end by the drum body or a part connected thereto.

41 Claims, 21 Drawing Figures

YARN STORAGE AND DELIVERY ARRANGEMENT, PARTICULARLY FOR TEXTILE MACHINES

The invention relates to a yarn storage and delivery arrangement, particularly for textile machines.

BACKGROUND

Yarn storage drums have been proposed in which a number of elongated yarn contact or support elements are arranged evenly around the circumference at equal radial distances from the drum axis; the elements extend essentially in the direction of the drum axis and are fastend at least at one end to a drum body. In the yarn contact section they form a yarn contact for several loops or turns of a storage winding. The arrangement also has yarn feeding and delivery elements assigned to the feeding and delivery side of the storage drum, and a drive arrangement to provide of relative rotational movement between the yarn drum, and the winding and unwinding elements.

Yarn delivery arrangements are known (see German Pat. No. 24 61 746) whose storage drum is designed in the form of a cylindrical bar cage on whose bars a yarn coming from a supply spool can be wound tangentially, thus forming the storage winding. The bars are located at some radial distance from the hub portion of the cylindrical body. The body has an upper and a lower circular flange in which the ends of the bars are secured. Each loop or turn of the storage winding theoretically contacts the circularly cylindrical rigid bar at a contact point. The spaces between each bar and the hub portion of the drum body effectively prevent the accumulation of lint which would impair the function of the yarn delivery arrangement. Such a storage drum designed as a solid bar cage is relatively heavy, i.e. it possesses a considerable inert mass. That is of minor importance as long as the storage drum is driven—as a rule jointly with the storage drums of other yarn delivery devices such as those belonging to a circular knitting machine—via an endless belt coupled with a drive source. Generally this belt drive cannot be stopped or started suddenly, and a stop-and-go operation of the storage drum is possible only when the storage drum is designed with its own interengaging clutch that can be engaged and disengaged. Because of its inert mass, the storage drum cannot immediately come to a standstill even when the clutch is disengaged. This would be desirable, however, for example, in circular knitting machines operating with striping attachments, as well as in some other applications. Furthermore such a yarn delivery arrangement is still relatively complicated to design.

The same considerations apply essentially to other similar yarn delivery arrangements (see German Pat. Nos. OS 28 08 203, PS 16 35 899) where the elongated yarn contact elements are separately designed as bar or cog-like parts of an appropriately slotted mantle of a pot-shaped drum body.

Since the yarn contact elements of the storage drums of such delivery arrangements are designed as straight bars, teeth, or etc., separate advance elements are required around which the continuously forming storage windings advance axially along the storage drum, so that the yarn loops or turns of the storage winding are always held in a predetermined yarn contact section. In this respect it is known to design the storage drum with radially protruding fingers or stirrup-like elements, extending, between the individual parallel straight bars that form the yarn contact elements. The protruding finger or stirrup-like elements form elements that can be cam-controlled and perform a limited axial up-and-down motion, pushing the storage winding forward along the yarn contact elements. In one known arrangement of this kind (see German Pat. No. OS 27 23 210) the advance elements are formed by elastic wire pieces protruding radially outward on one side of the drum body, whose one end is fastened to a hub of the drum body and whose other end engages in a hub-like cam travel arranged on a fixed ring surrounding the rotating storage drum at a distance. Another arrangement of this kind (see German Pat. No. OS 31 04 516) has a triangularly bent part and partition elements that protrude radially between the bars that form the yarn contact elements; the partition bars divide the storage winding and resemble wire stirrups whose one end is fastened to a yarn advance element that is cam-controlled and moves axially back and forth on two adjacent yarn contact elements.

THE INVENTION

It is an object to provide a yarn delivery arrangement whose storage drum is characterized by an especially simple and reliable design of low inert mass permitting for example exact stop-and-go operation with a drive by means of a low power stepping motor, while ensuring the automatic advancement of the loops or turns of the storage windings.

Briefly, the yarn storage and delivery arrangement according to the invention comprises yarn contact elements formed by essentially L- or U-shaped narrow, low-inertia stirrups or bails having one end guided by or fastened to the drum body or a part connected with same. Each stirrup has, on the yarn supply side a section that tapers radially inwardly toward the yarn delivery side. The tapered section is followed by a yarn contact section on the stirrup.

Contrary to straight, solid bars, ribs, etc., these bails or stirrups can be made with a very small mass and without great production expense in practically any appropriate shape, so that in conjunction with a lightweight, preferably plastic drum body a very simple design and an extremely small inert mass of the storage drum can be achieved. The yarn contact elements are oriented in the general direction of the axis of rotation of the drum and positioned coaxially therewith. At the same time the stirrups positioned at a distance in circumferential direction ensure the perfectly slip-less coupling between the turns of the yarn winding and the storage drum, while on the other hand any impairment through the accumulation of lint, etc. is largely eliminated.

In a preferred embodiment of the invention the stirrups whose yarn contact sections preferably are located at some radial distance from the drum body or hub are elastic in at least some portions, and in relation to the drum body they are guided in such a way that they are capable of limited radial motion. It should be noted in this connection that it is known per se (see German Pat. No. OS 24 36 936) to have yarn contact elements designed as elastically fastened sheet metal plates that are guided in relation to the drum body in such a way that they are capable of limited radial movement.

A very simple arrangement is possible when the essentially L- or U-shaped stirrups have not only a concavely outwardly bent or straight yarn contact section, but also an—if necessary—elastic first stirrup leg by which they are fastened to the drum body. This first stirrup leg can also be guided laterally in the vicinity of its attachment to the drum body to prevent lateral deflection of the stirrups caused by the yarn that runs on at the yarn feeding or supply side, especially when it is under increased tension. The stirrups can be fastened to the drum body by embedding or otherwise inserting the first stirrup legs into the drum body material. A successful attachment is obtained by inserting the first leg of each stirrup into the drum body with a bent-over fastening part, held down by a locking means such as a disk.

To ensure that even when the stirrups are made of very thin and thus low-inertia material, they maintain their direction in relation to the drum axis under all operational conditions, the stirrups can be provided with a second leg running more or less radially to the drum body from the yarn contact side opposite the first leg. This second leg is designed as a guide element, interacting with appropriate guide means of the drum body or of a part connected therewith. The stirrups can be guided by their second leg laterally and/or radially, and this can be successfully achieved when the drum body has slots in which the second legs are guided. Such slots can preferably be arranged at least in the area of a face of the essentially pot-shaped, circularly cylindrical drum body.

To increase stability, the stirrups can be supported with prestress in the direction of the drum axis by their second legs on a contact surface in the floor of the drum body.

Desirably, the stirrups are radially supported downward on the yarn contact side away from the supported toward the outer side, by being supported on the yarn contact side away from the first legs. This ensures that the stirrups with their yarn contact sections can be elastically pressed slightly inwardly by the yarn windings, so that they adjust automatically to the tension conditions of the yarn windings. spreading of the stirrups radially outward by centrifugal force when the yarn tension is very low and thus impairment of the storage winding is thereby also prevented. Preferably the stirrups can be elastically prestressed radially outwardly with respect to their support, so that they act with a defined, predetermined resistance upon their deflective radial inward motion.

In a preferred practical embodiment the drum body may have or carry a disk or star-shaped support element for the stirrups on which support or—if required—the guide surfaces for the stirrups can be located.

This circular disk-shaped support element can also have a bulb-like outer circumferential surface to allow the a bulbous or bead-like outer circumferential surface to allow the perfect overend or overhead unwinding of the yarn, should this be required in the yarn delivery or storage arrangement used. Since the support element is usually made of relatively soft plastic, it is advantageous when the support element carries on its outer circumferential surface a yarn unwind ring, made of wear resistance material such as spring steel, that prevents cutting-in of the yarn. If the support element is designed in several parts, the yarn unwind ring can at the same time hold the yarn support element together.

In another embodiment the arrangement can be designed in such a way that the second legs of the stirrups have bent fastening elements with which they can be supported by the support element.

The free ends of the second stirrup legs are advantageously covered with a cover element placed on or attached to the drum body floor; this prevents yarn loops that may form on the delivery side when the tension of the unwinding yarn decreases from hooking behind the ends of the stirrup legs.

The radially inwardly tapered section on the yarn feeding side can directly form part of each stirrup. But the arrangement can also be such that the tapered section on the yarn feeding side is formed in at least a part of the drum body or a part connected therewith that protrudes radially outward beyond the stirrups. The tapered sections lie on an imaginary circular cone. Through these inwardly tapered sections an automatic advance is produced of the constantly newly formed yarn turns or loops of the storage winding on the feeding side without requiring separate advance means. The axial advancement of the storage lap can occasionally be impeded, for example when the yarn is not taken off the storage drum, i.e. in cases of malfunction, and this can result in additional yarn windings accumulating on the yarn feeding side. To prevent the yarn from entering the gap between the holder and the adjacent face or storage drum and from wrapping around the shaft that carries the storage drum, the storage drum can be designed on the yarn feeding side with at least one yarn deflector that reaches up to the imaginary circular cone on which the tapered sections of the stirrups lie. It has proved very effective when the yarn deflector is designed with an essentially convex deflection edge or surface beside the storage drum.

The stirrups of the storage drum are relatively easy to make and, as mentioned above, they can be designed in any appropriate shape without great expense. Thus for example it is possible for each stirrup to have at least two yarn contact sections from each other by a radially protruding bead or bulb-like separation section. Each stirrup can also carry on the yarn delivery side, adjacent to the yarn contact section, a radially outwardly extending broadening section, with the broadening sections of all stirrups in turn lying on an imaginary rotational body.

The thin-walled, preferably essentially pot-shaped drum body is usually made of plastic. It can have slot-like apertures in the sections between the stirrups, to further reduce the material used and the inert mass of the storage drum. At the same time these slot-like apertures can also be used to ventilate outwardly the contacting loops or turns of the storage winding, so that lint, etc. is blown off. For similar reasons the stirrups can also have parts acting as fan blades.

In a preferred embodiment the stirrups consist of a thin spring steel material, i.e. they are shaped in the form of hardened, stainless bent steel wires which as a rule require no surface treatment or coating, although such measures could, of course, be provided in individual cases. The stirrups can also be hardened only in certain sections along their length, where it is important to ensure elasticity or special surface conditions.

In another embodiment the stirrups may be designed as flat shaped pieces, for example produced by punching, and formed to serve as fan blades themselves in the yarn contact section.

A storage drum which is equally well suited for left-hand and right-hand operation has the stirrups situated in radial planes containing the drum axis. When when it can be assumed that the storage drum is operated only in one rotational direction, the stirrups may lie in planes that run tangentially to a rotational body coaxial to the drum axis, for example to a circular cylinder or a circular cone.

The described yarn delivery and storage arrangement can in principle be used in all yarn-consuming machines and for all purposes where an even yarn delivery is important. Its storage drum can be driven as usual in circular knitting machines via an appropriate pulley by an endless drive belt, but it is also very well suited for individual drive by means of a small electric motor since, as explained above, it can be designed with an extremely small inert mass. In this manner it is possible to create an "independent" yarn delivery and storage arrangement that delivers the yarn under exactly maintained, predetermined conditions without requiring monitoring from outside through separate monitoring devices, etc.

DRAWINGS

DETAILED DESCRIPTION

Figure 1:
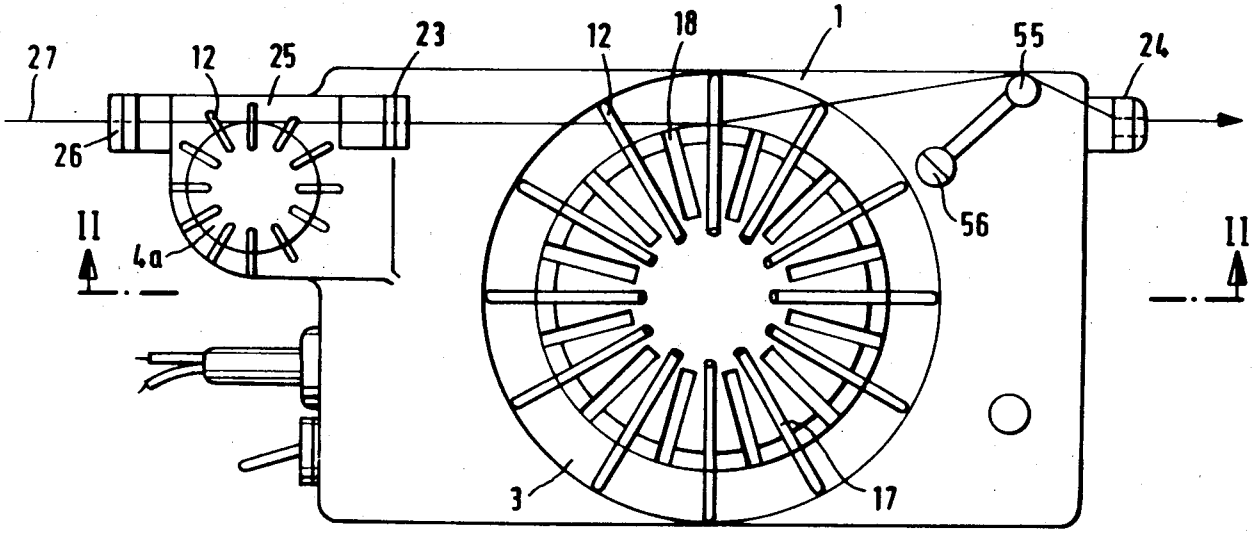
FIG. 1 shows an independent yarn delivery and storage arrangement according to the invention, seen in plan view.
Figure 2:
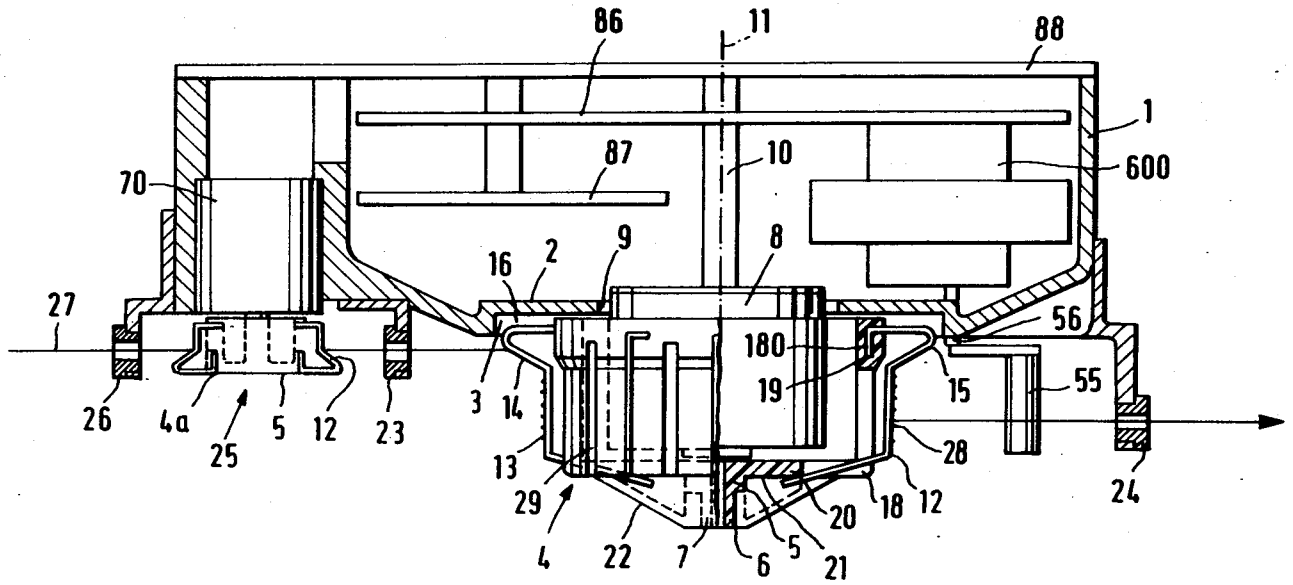
FIG. 2 shows the yarn delivery and storage arrangement according to FIG. 2, cut along line II—II in FIG. 1, seen in a side view.

The yarn delivery and storage arrangement shown in FIGS. 1 and 2 has a holder 1 in the form of a rectangular, flat housing with parallel sides that can be fastened, for example to a circular knitting machine, by means of fasteneing arrangements not described here in detail. The outside of the level floor 2 of holder 1 has a circular cylindrical cavity 3 into which protrudes a storage drum 4 that is arranged coaxially to cavity 3. The storage drum 4 has an essentially pot-shaped drum body 5 made of plastic that is attached to shaft 7 of an electric motor, in particular a stepping motor 8, by means of a hub 6. The motor 8 is rigidly connected with holder 1 by fastening element 10 and protrudes through opening 9 in floor 2. Drum body 5 carries a number of elongated yarn support members or elements, in form of L or U-shaped bails or stirrups 12 that are evenly distributed around the circumference at equal radial distances from the drum axis 11, i.e. coaxial with axis 11. The stirrups are oriented in the general direction of the axis 11. They are shaped from thin spring wire and have smooth surfaces. The spring wire may have a circular or other cross-section, for example rectangular. It may have the same elasticity throughout the length of the stirrups, but it is also conceivable to have embodiments where each stirrup 12 is made only partly elastic through appropriate hardening of certain sections.

Each elastic stirrup 12 is essentially shaped in the form of a U; parallel to drum axis 11 it has a largely straight yarn contact section 13, followed on the yarn feeding side, i.e. at the top in FIG. 2, by section 14 that is tapered toward the inside; this section 14 ends in arc 15 that eventually becomes the more or less horizontal first stirrup leg 16 running essentially in radial direction in relation to drum axis 11. On the side opposite the first stirrup leg 16, i.e. in the yarn contact section 13, each stirrup also has a second leg 17 that also essentially runs in radial direction to drum axis 11. The first and second stirrup legs 16 and 17 of all stirrups 12 lie on common imaginary circular cones coaxially to drum axis 11, while the yarn contact sections 13 of stirrups 12 are on an imaginary circular cone that is also coaxial.

Adjacent to their first legs 16, the stirrups 12 have rectangularly bent brackets 180. Brackets 180 are embedded in an appropriately broadened mantle 19 of the pot-shaped drum body 5, so that the lateral guidance of the first stirrup legs 16 is ensured in the vicinity of the attachment of the stirrup to the body 5.

The second legs 17 of stirrups 12 lie in slots 18 that run radially to drum axis 11; these slots 18 are formed in bottom 20 of drum body 5, and their width is somewhat greater than that of stirrups 12. Thus stirrups 12 are guided laterally in slots 18 via their second stirrup legs 17; legs 17 are also supported with axial prestress on support surface 21 on floor 20 of drum body 5, Thus each of the stirrups 12 is rigidly fastened to drum body 5 near its first leg 16, i.e. at the yarn contact side, while it is guided with radially limited movement along drum body 5 at the other end, i.e. near its second leg 17; the walls of slots 18 guide stirrups 12 laterally in this latter area.

In the vicinity of its floor 20, drum body 5 is designed with cover 22 which is roughly in the shape of a truncated cone, into which the slots 18 protrude and which prevents the yarn from becoming entangled in the ends of the second legs 17.

Laterally to storage drum 4, holder 1 has a stationary yarn run-in eyelet 23 and a stationary yarn delivery eyelet 24 as well as a second yarn run-in eye 26 ahead of a yarn brake 25.

The yarn 27 is drawn off a supply spool not described here in detail and runs through run-in eye 26 via yarn brake 25 and run-in or supply eyelet 23 tangentially to the inwardly tapered sections 14 of stirrups 12 of storage drum 4. Drum 14 is driven by stepping motor 8. The yarn windings produced there are pushed axially downward, as seen in FIG. 2, into the essentially straight yarn contact section 13 because of the inclination of stirrup sections 14, where they form a storage winding consisting of several yarn loops or turns. Yarn 27 is then drawn off from storage winding 28 and fed to a yarn consumer not described here.

The stirrups 12 can—influenced by the tension exerted by the yarn of storage winding 28—elastically move inwardly about their arc sections 15 to some extent. The slightly slanted second stirrup legs 17 are prestressed and can slide slightly inwardly along support surface 21. This causes the yarn contact sections 13 of stirrups 12 to become slightly slanted and to lie on a common cone coaxial to drum axis 11. This promotes the axial advance of storage lap 28.

The elastic resistance offered by stirrups 12 to this inward motion of their yarn contact section 13 depends not only on the elastic properties of stirrups 12 in the area of their bend or hinge at arc 15, but also on the prestress with which the second legs 17 are supported at support surface 21. When these values are appropriately dimensioned, special characteristics of the yarn material to be wound could be taken into account, if necessary. It is even conceivable that stirrups 12 are rigidly connected with drum body 5, so that they are unable to perform elastic deflective movements.

Slot-like apertures 29 are formed in mantle 19 and in floor 20 of the pot-shaped drum body 5, between adjacent stirrups 12. The apertures 29 reduce the already small mass of storage drum 4 even further and also act as ventilation holes for the revolving storage drum 4, cooling stepping motor 8 and providing openings through which the yarn windings of storage pile 28 are radially ventilated and blown off toward the outside.

In the modified embodiments of the storage drum shown in FIGS. 3 to 7, parts that are the same as in the storage drum according to FIGS. 1 and 2 are identified by the same reference numbers, so that no additional explanation is necessary.

Figure 3:
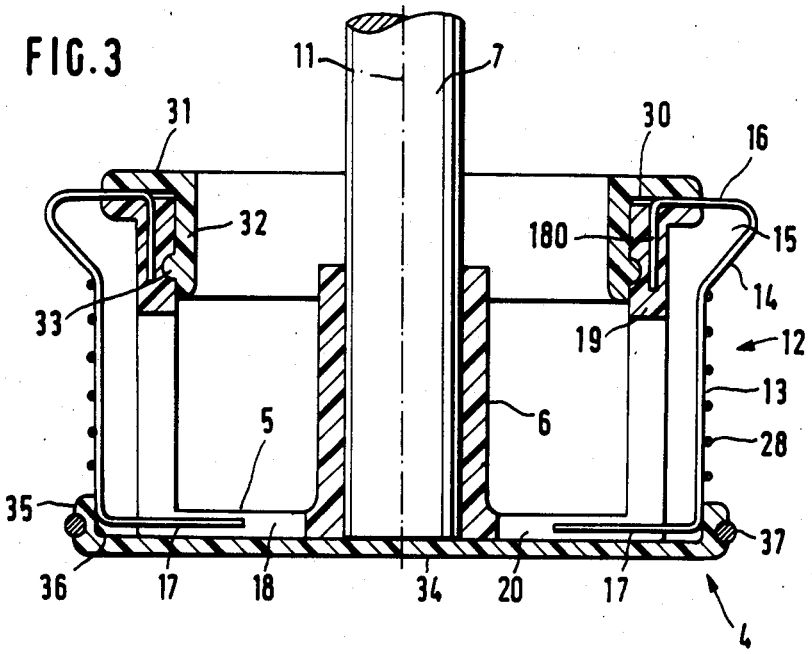
FIG. 3 shows the storage drum of the yarn delivery and storage arrangement according to FIG. 2 in a modified embodiment in axial section seen in a side view and drawn to another scale.

In the embodiment according to FIG. 3 the U-shaped wire stirrups and their fastening elements 180 are inserted into corresponding axially parallel drill holes in drum body mantle 19. Their first stirrup legs 16 are guided laterally in groove-like cavities 30 of the face surface of drum mantle 19, running roughly in radial direction. They are locked by means of a holding ring 31 that is inserted into drum body 5 by means of flange 32 and locked against drum body mantle 18 at 33 by means of a circumferential bead and an associated cavity.

With their second roughly horizontal legs 17 the stirrups 12 protrude into slots 18 which thereby, in the area of floor 20 effect the lateral guidance of stirrups 12.

On the side away from the first stirrup legs 16, i.e. on the yarn contact side 13, the stirrups 12 are radially outwardly supported in reference to the drum body 5. For this purpose a coaxial support disk 34 has been placed into floor 20 of drum body 5 which on its circumferential surface carries a ring flange designed as a bead 35 that has on its inside a more or less circular cylindrical support surface 36 against which the stirrups 12 are braced at the bottom end of their yarn contact section 13. The stirrups 12 are radially pre-stressed toward the outside and thus abut with prestress at the support surface 36. By dimensioning this prestress appropriately, the elastic resistance can be determined which the stirrups exert as they swivel slightly inward, as already described.

Bead 35 of support disk 34 has a yarn unwind ring 37 made of spring steel whose surface can also be coated and which holds the support disk 35 together if the latter is designed in several parts.

The storage drum 4 according to FIG. 3 is well suited for the or overhead unwinding of the yarn from storage lap 28. The yarn runs over yarn unwind ring 37 which is made of wear-resistant material and thus ensures that the yarn unwinds perfectly.

Figure 4:
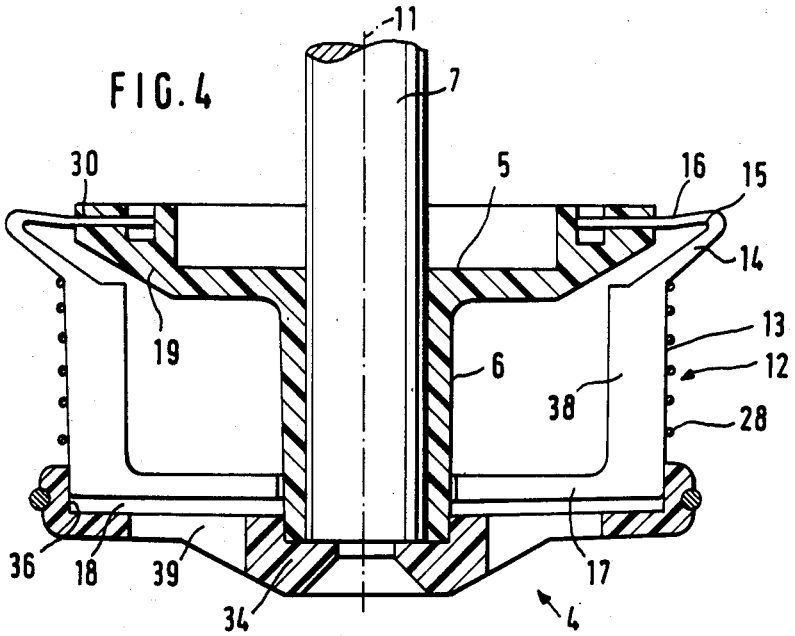
FIG. 4 shows the storage drum of the yarn delivery and storage arrangement according to FIG. 2 in a second modified embodiment seen as in FIG. 3.

In the further embodiment of storage drum 4 shown in FIG. 4, the stirrups are formed as essentially U-shaped flat steel plate parts which, however, could also made of other material such as plastic. In each stirrup 12 the stirrup part 38 that corresponds in its outer narrow face to yarn contact section 13 is designed as a fan blade which is followed on the one side by the narrow arm-like, inwardly tapering section 14 with the narrow also arm-like first stirrup leg 16 and on the other side by the also arm-like narrow second stirrup leg 17. While stirrup part 38 is essentially rigid, the first stirrup leg 16 has a certain elasticity, at least in the arc section at 15 or near the place where stirrup leg 16 is engaged, and this allows stirrup 12 to be radially prestress toward the outside, so that it abuts support surface 36 of support disk 34 and can be swivelled toward the inside radially by the forces exerted by the yarn loops of storage winding 28 about a hinge point that lies in the vicinity of section 15.

The first stirrup legs 16 of stirrups 12 are in this case again set into groove-like cavities 30 in the face of drum body mantle 19. Welding of the plastic material retains the legs 16 in the area of the groove-like cavities 30.

The air stream moved by the stirrup parts 38 acting as fan blades enters into drum body 5 through apertures 39 in the support disk 34 which at the same time forms the floor of the drum body 5, and between stirrups 12 where it is radially directed outward; at the same time it blows through the yarn storage 28. Since in this case the drum body mantle 19, starting from hub part 6, extends only through the section above the stirrup parts 38, there are no parts between stirrup parts 38 that prevent the passage of air.

Figure 6:
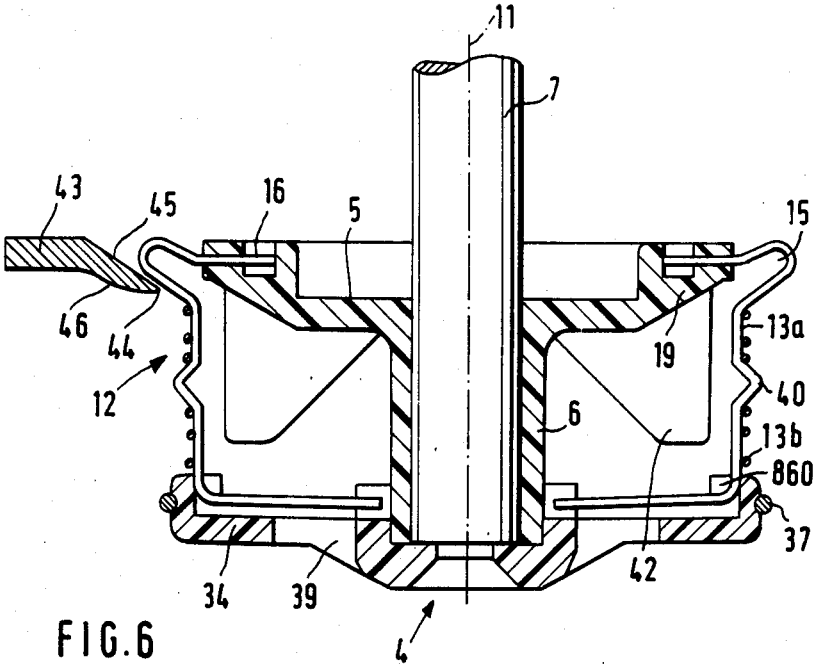
FIG. 6 shows the storage drum of the yarn delivery and storage arrangement according to FIG. 5, cut along line VI—VI of FIG. 5 seen in a side view showing the yarn deflector, and drawn to a different scale.
Figure 7:
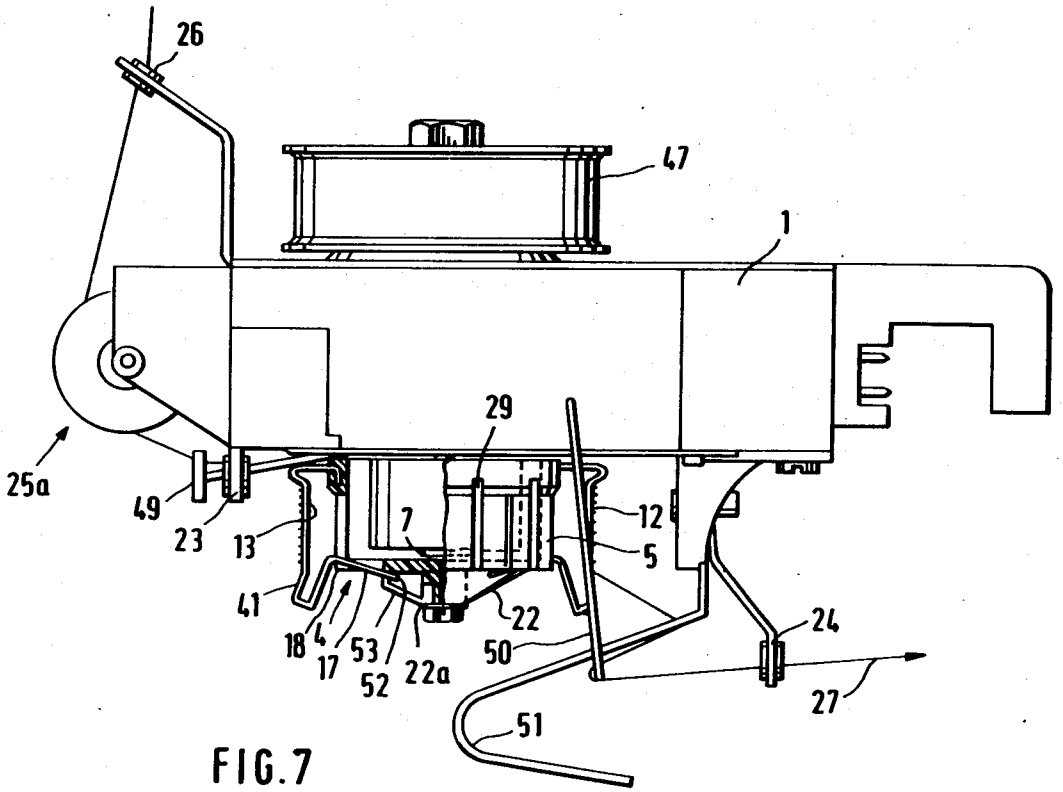
FIG. 7 shows a yarn delivery and storage arrangement according to the invention in a further embodiment, seen in a side view with parts of the drum cut away.

Regardless of whether they are, as in embodiments according to FIGS. 2 and 3, bent from wire or, as in embodiments according to FIG. 4, made of punched parts, the stirrups 12 can be produced in any shape without increasing the manufacturing costs. Thus it is possible, for example, to subdivide the straight yarn contact section 13 in each stirrup by a bulge-like protruding separation area 40 into two yarn contact sections **13*a* and 13*b*, as shown in FIG. 6, or, as shown in FIG. 7 to provide a radially outwardly broadening section 41 on the yarn run-off side, =beneath the yarn contact section 13. The outwardly broadening sections 41 of all stirrups 12 again lie on a common imaginary circular cone or another appropriate rotational body. They prevent—if necessary in view of the yarn to be processed or in view of the operating conditions—the lower windings of storage lap 28 from draping downwardly from storage drum 4**.

Figure 5:
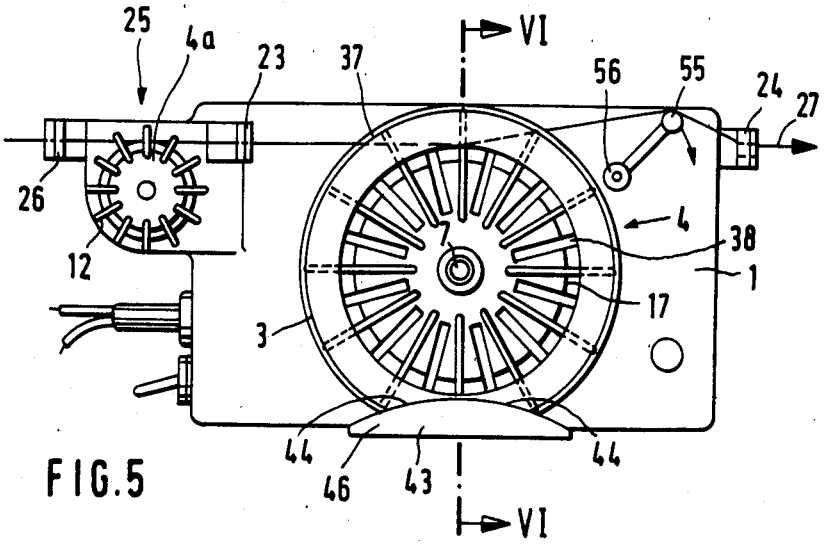
FIG. 5 shows the yarn delivery and storage arrangement according to FIG. 1 with an associated yarn deflector in a plan view and drawn to a different scale.

The drum body 5 of the storage drum shown in FIGS. 5 and 6 is similar to that shown in FIG. 4. Since in this case the stirrups 12 are bent from wire, separate fan blades 42 are provided for ventilating the yarn windings of storage lap 28. These fan blades 42 lie in the ring space enclosed by stirrup sections 13 and form part of the drum body mantle 19 in radial direction, while the mantle 19 protrudes in the manner of a ring flange.

If the yarn consumer does not remove yarn from storage winding 28 in case of a malfunction or if the axial advancement of yarn of winding 28 is impaired for other reasons it can happen that with a still running storage drum 4 windings accumulate on the inwardly tapered sections 14 of stirrups 12 which eventually, unless the yarn delivery system is shut down in time, will enter the space between bottom 2 of holder 1 and the adjacent face of drum body 5, where they wrap around shaft 7.

To prevnt this, a yarn deflector 43 is provided, see the embodiment according to FIGS. 5 and 6. On the underside of holder 1 adjacent to storage drum 4 with a yarn deflector 43 as shown in FIG. 6, protrudes with a convex yarn deflector edge 44 into the area of stirrup sections 14 which describe an imagninary circular cone. Yarn deflector 43 has a slanted surface 45 which runs from the yarn deflector edge 44 about parallel to stirrup sections 14, at a slight distance from the stirrup sections 14. A gently curved deflector surface 46 extends from edge 44 so that the result is the wedge-shaped cross-section shown in FIG. 6.

Should yarn windings accumulate in stirrup sections 14, yarn deflector edge 44 guides yarn to yarn deflector surface 46 and thus prevents yarn from climbing up further along stirrup sections 14.

The yarn delivery arrangement shown in FIGS. 1 and 2 has a separate electric motor 8 to drive storage drum 4. But it is also possible in general to rotate storage drum 4 in the conventional manner via a drive belt as it is used in circular knitting machines to drive all yarn delivery arrangements along the machine. One embodiment of such a yarn delivery arrangement is shown in FIG. 7:

Shaft 7 carrying the storage drum 4 is pivoted in holder 1 and carries on the upper side of the holder a drive pulley 47 that is fixed against relative rotation.

In this case the storage drum 4 is combined with a conventional disk-type yarn brake 25*a*. FIG. 7 also illustrates a yarn supply sensor 49 and a yarn delivery sensor 50 as well as a loop deflector bail 51.

In this case the storage drum 4 corresponds in its basic design to the embodiment according to FIGS. 1 and 2. Apart from the outwardly protruding lower stirrup sections 41, the stirrups 12 deviate, however, from the embodiment according to FIGS. 1 and 2 in that they have additional radial support toward the outside. For this purpose the stirrups 12 are provided at each of their second legs 17 with a hook-like bent bracket 52 which hooks behind a corresponding circular cylindrical holding surface 53 of a cover element 22*a* that is attached to the drum body floor 20.

Of course the other already described embodiments of storage drum 4 can be used as well. Stirrups 12 may lie in the radial planes containing the drum axis 11 or—in case of a storage drum drive in one direction only—the arrangement can be designed in such a way that the planes containing the stirrups 12 run tangentially to a circular cylinder or cone that is coaxial to drum axis 11.

As already noted, the yarn delivery arrangement according to FIGS. 1 and 2 is independent of an extraneous drive source. Since electric motor 8 can be designed only for a relatively low nominal power, the associated electric circuit can be accommodated without difficulty in the housing-like holder 1. It is thus possible to process additional information in this circuitry which makes the yarn delivery arrangement an independent yarn delivery apparatus that is able not only to deliver yarn in continuous stop-and-go operation, but also to maintain a predetermined tension for the yarn automatically and to ensure that the yarn coming from the supply spool is always wound with constant tension which results in a perfect buildup and advancement of the storage winding 28.

FIGS. 1 and 2 show an electric yarn brake 25. Yarn brake 25 contains a D.C. motor 70 set into a corresponding drill hole in holder 1; the motor carries a second storage drum 4*a* which is generally similar to the storage drum 4 that has already been described by means of several embodiments; it differs mainly in that its diameter is smaller. Its stirrups 12 and its drum body 5 are only indicated schematically in FIGS. 1 and 2.

The yarn 27 feeding through run-in eye 26 is wrapped around yarn drum 4*a* several times and is therefore coupled therewith in a slip-free manner. D.C. motor 70 is acting as a dynamic braking unit and is driven by the running yarn against its impressed sense of rotation, i.e. it has a tendency of driving yarn drum 4*a* in the opposite rotational direction from that of storage drum 4. But is torque is much lower than that of stepping motor 8, so that it develops a braking torque that acts via yarn drum 4*a* upon yarn 27 and that ensures that yarn 27 is always wound onto storage drum 4 at a predetermined yarn tension.

The value of this braking torque of electric motor 70 can be permanently set or continuously controlled by appropriately influencing one of its electrical input quantities such as current and/or voltage.

The circuit components of the associated control circuit are designed as printed circuits whose boards 86 and 87 are accommodated, together with the housing 600 of a yarn signal generator, in holder 1 whose interior space is closed by means of an attached lid 88 (see FIG. 2).

The yarn running off from the storage drum 4 is scanned by a spring-loaded sensor 55 (FIG. 1) which turns a shaft 56 which is coupled to yarn signal generator 600 to provide a yarn tension signal. Generator 600 is a rotational angle indicator. The signal is fed into the control circuit and controls the electric motor 8 so that constant run-out yarn tension is ensured.

In the described storage drums 4 the stirrups 12 are essentially U-shaped. But it is also conceivable to have embodiments in which these stirrups 12 are essentially L-shaped, i.e. without second stirrup legs 17. In that case the stirrups may, for example, be guided only in appropriate slots 860 (FIG. 6) of support disk 34 or floor 20 of drum body 5 in a lateral or radial direction, as will be described below.

However, the significant factor is in this case that a slip-free coupling is ensured between the yarn loop or turns of storage winding 28 and the yarn contact sections 13 of stirrups 12 which stand at a radial distance from the adjacent parts of drum body 5.

In the embodiments of the storage drum 4, 4*a* shown in the drawing, the stirrups lie in the planes containing the drum axis 11. Thus the storage drums can be used equally well in both directions. But in principle, in certain applications an embodiment could be advantageous in which the stirrups 12, in reference to the drum axis 11, lie slightly "slanted", i.e. in planes that cross the drum axis at an acute angle. This angle could lie roughly between 3° and 5°, but other angles are conceivable as well. Similarly the stirrups could have a yarn contact section 13 that is spiral-shaped. Such a slanted position of the stirrups 12 could prevent, for example, that the storage winding drops downwardly. However, in these cases, too, the stirrups 12 are so fastened to the drum body 5 that they extend essentially in the direction of the drum axis. When the stirrups 12, as described above, are made of an elastic material such as spring wire and are rigidly fastened to drum body 5 only by their first legs 16, i.e. at one end, they are, as practical experience has shown, subject to slight oscillations caused by the winding on or running-off yarn. The reason is that the stirrups are arranged in such a way that their yarn contact sections 13 are distributed along the circumference of storage drum 4 or 4*a*, so that strictly speaking the yarn does not contact a smooth cylindrical surface but the angular edges of a polygonal revolving body formed by the yarn contact areas 13. This dynamic behaviour of stirrups 12 considerably facilitates and promotes the axial advancement of storage winding 28.

In FIGS. 8 to 21 show further modified embodiments of storage drum 4.

Figure 8:
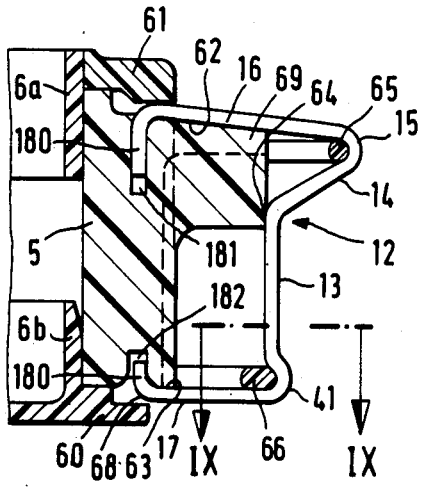
FIG. 8 shows the storage drum of the yarn delivery and storage arrangement according to FIG. 2 in a third modified embodiment, in axial section, seen in a side view and in a partial presentation.
Figure 9:
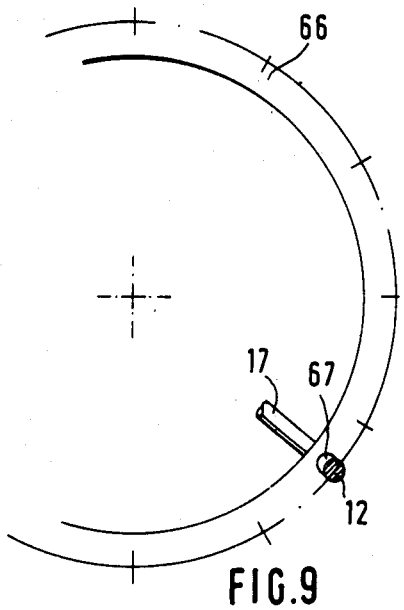
FIG. 9 shows the storage drum according to FIG. 8, cut along line IX—IX in FIG. 8 in a plan view and a partial presentation in the area of the support ring.

In the embodiment according to FIGS. 8 and 9, drum body 5 is set on a two-part hub 6*a*, 6*b* whose lower hub part 6*b* carries a, radially outwardly protruding ring flange 60, while the upper hub part 6*a* is fitted with a lid-like ring washer 61. Ring flange 60 and ring washer 61 overlap the second and first stirrup legs 17 and 16 of the U-shaped wire stirrups 12 in the area where they are fastened or guided, in the manner shown in FIG. 8. The elastic stirrups 12 are designed again with an inwardly tapered section 14 that eventually becomes first stirrup leg 16 via an arc 15. On the other side of the straight yarn contact section 13 each stirrup 12 is designed with a rib-like, outwardly protruding bent stirrup section 41 which is followed by the second stirrup leg 17. Both legs 16 and 17 carry at their ends a roughly rectangular, angled fastening element 180, the arrangement being that the two fastening elements 180 of a stirrup 12 are coaxial to each other. The two fastening elements 180 of a stirrup 12 are placed inside coaxial holes 181, 182, respectively, of drum body 5 which are coaxial to each other. The fastening elements 180 are held in these holes 181, 182 by the overlapping ring flange 60 and the ring washer 61. While the cylindrical aperture 181 corresponds exactly to the associated fastening element 180, locking same in position, the other aperture 182 is designed with a larger diameter which has the result that the lower fastening element 180 and thus also the second stirrup leg 17 of each stirrup is guided to have limited radial and lateral movement. The stirrups 12 are supported by their legs 16 and 17 in the direction of the drum axis, on contact surfaces 62, 63 of drum body 5; they are under such prestress that their two legs 16 and 17 lie with elastic force on contact surfaces 62 and 63. Furthermore, in the area of the upper yarn contact section 13, i.e. where it becomes section 14, a radial support 64 has been provided against drum body 5; this support is not very long axially.

During assembly the stirrups 12 can simply be hooked into apertures 181, 182 by their fastening parts 180.

Within arc 15 and the rib-like bent section 41 of stirrup 12 are an endless yarn deflection rings 65 or 66 coaxial to the drum axis which may be made of plastic, for example, and which prevent that yarn can get between the individual wire stirrups 12 and become entangled there, which could lead to torn yarn. If necessary in certain cases, the two deflection rings 65, 66—or at least one of them—could also provide support and stability for stirrups 12.

As FIG. 9 shows the lower deflector ring 66 is designed in the area of stirrups 12 with radial, outwardly open-edged slots 67 into which the individual stirrups 12 partly engage with their sections 41. The width of slots 67 corresponds to the diameter of stirrups 12. Stirrup 12 are made of cylindrical spring wire material; the depth of slots 67 is approximately equal to one half of the wire thickness of a stirrup 12, which means that stirrup 12 is embedded in such a slot 67 to about half of its diameter.

The upper deflector ring can be designed correspondingly; but the arrangement can also be such that this deflector ring 65 is rigidly connected to the stirrups 12 which, for example, may be embedded in it.

The stirrups 12 are made of elastic wire material and have limited movability where their lower fastening elements 180 fit in holes 182. This movability is not impaired by the length of slots 67 in the lower deflector ring 66. To prevent impairing this movability, a space or gap of several tengths of a millimeter is provided between ring flange 60 and the second stirrup legs 18, as shown at 68. The stirrups 12 then can have a straight yarn contact section 13 which, when seen in a top view, tapers conically when the radial force exerted on yarn contact section 13 by the yarn winding becomes greater than the prestress of the stirrups. This taper is limited by the lower fastening element 180 abutting at the inner edge of aperture 182. When deformed in such a manner, the straight yarn contact sections 13 of all stirrups 12 lie on a theoretical circumference of an imaginary circular cone whose apex is on the yarn delivery side and on the drum axis.

Since each stirrup 12 is radially supported at 64, the above explained inward swivelling motion of the lower parts of stirrups 12 is mainly limited to their yarn contact sections 13 and the adjacent rib-like sections 41. The radial support points at 64 can lie not only—as shown in FIG. 8—on reinforcement ribs, but also on a fan blade that forms part of drum body 5 and is numbered 69 in FIG. 8, where its delineation toward drum body 5 is shown by a dotted line.

In the unloaded basic position of stirrups 12 shown in FIG. 8, their straight yarn contact sections 13 usually lie on a circular cylinder. When the storage winding is full, and particularly in the case of poorly conveyable yarn, an elastic deformation of stirrups 12 can occur against the prestress, as explained above, so that the yarn is axially moved from an initially larger winding diameter to a smaller one, resulting in a slight tension release of the storage winding and facilitating the easier movement of the yarn.

In principle the same results can be achieved when stirrups 12 are designed without their own prestress, and forming the lower deflection ring 66 of a flexible material rigidly connected with the stirrups 12. Thus the elastic deformation of the deflector ring 66 produces a corresponding radial elasticity in stirrups 12.

It is also conceivable for stirrups 12 in unloaded basic position to lie with their yarn contact section 13 on a circular cone whose apex lies on the drum axis at the yarn feeding or supply side of the drum. This means that the winding diameter increases slightly from the yarn feeding side to the yarn delivery side. Such an arrangement may be advantageous, for example, when smooth, non-elastic yarns are to be processed which by nature find little hold on the yarn contact sections 13 of stirrups 12, so that the windings have the tendency of falling off. The above mentioned enlargement of the winding diameter continuously over the length of the yarn contact sections of stirrups provides a certain compensation within the limits of elasticity of the yarn material.

In this embodiment the arrangement can be effectively designed in such a way that in each radially inward directed wall of fastening element 180 abutting to aperture 182, the yarn contact section 13 of each stirrup 12 lies on a circular cylinder coaxial to the drum axis.

The rib-like, outwardly bent sections 41 of stirrups 12, together with the lower deflector ring 66, form a yarn wind-back border, similar to, for example, yarn run-off ring 37 (FIG. 3) which also serves the purpose of retaining loose yarn windings that fall off. This yarn wind-back border also serves the purpose, as experience has shown, to carry the yarn along, exerting a certain force on excess yarn, without, however, pulling it too much. The outside diameter of the imaginary rib-like rotational body formed by sections 41 of stirrups 12 should ideally bear a certain relationship to the outer diameter of the lower deflector ring 66. The best results were achieved when, as already explained, the stirrups 12 are embedded with their rib-like sections 41 in slots 67 of deflector ring 66 approximately up to half their wire thickness. This also ensures that in the case of overhead unwinding of the yarn from the storage drum by hand (for example when excess yarn rises above the normal windings or wrap on the storage drum) the yarn can readily be pulled off without drag or tearing.

The parallel position of the stirrups 12 and the deflector rings 65, 66 gives the storage drum an open design which allows the free passage of air along the storage winding that is arranged along yarn contact sections 13 of stirrups 12. The rib-like moulded portions of drum body 5 that are designed as fan blades 69 have in addition to their support function for drum body 5 the function of providing an air stream.

Figure 10:
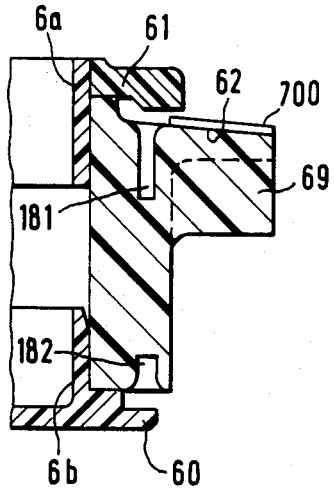
FIG. 10 shows the drum body of storage drum according to FIG. 8 in axial section seen in a side view and in a partial presentation.

The drum body 5 in the embodiment according to FIG. 8 is again shown in FIG. 10, but without stirrups 12. FIG. 10 shows that in the area of the upper contact surface 62 the first legs 16 of stirrups 12 are designed with lateral guide ribs 700 that lead to the associated aperture 181 and ensure the lateral guidance of stirrup legs 16. While the diameter of the upper cylindrical aperture 181 corresponds roughly to the wire diameter of a stirrup 12, the diameter of the associated cylindrical aperture 182 is approximately 0.15 mm larger than the wire diameter.

Figure 11:
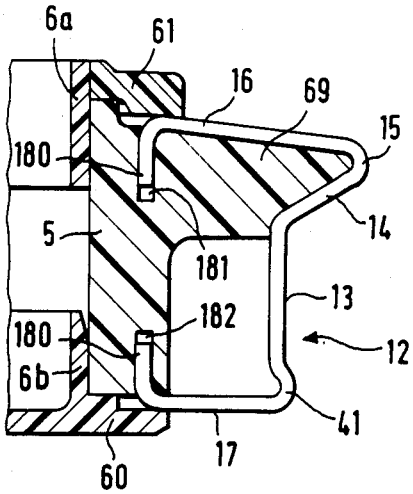
FIGS. 11 to 18 show the storage drum of the yarn delivery and storage arrangement according to FIG. 2 in further modified embodiments, each in axial section, seen in a side view and in a partial presentation.

In principle the embodiment according to FIG. 11 corresponds to that in FIGS. 8 to 10, but with the exception that the stirrups 12 are supported along the entire length of their first legs 16, their arcs 15 and their slanted sections 14 by the lower part 69 of drum body 5 that is also subdivided by ribs.

Furthermore the stirrups 12 are radially, non-slideably fastened on both sides to the cylindrical apertures 181, 182 by their fastening elements 180, which means that the diameter of the two cylindrical apertures 181, 181 of each stirrup 12 is the same as the diameter of the wire. Ring flange 60 lies directly on the second legs 17. The deflector ring 65 is not shown in the drawing. Section 69 of drum body 5 that is shown in FIG. 11 in cross section is a solid body around its entire circumference so that no yarn can enter in this section between stirrups 12.

The presentation according to FIG. 11 together with that of FIG. 8 can also be understood in such a way that it shows a differently presented sectional view of an embodiment according to FIG. 8 in which alternately one stirrup 12 is guided according to FIG. 8 with its lower second leg 17 so that it is capable of performing a limited radial movement, and both ends of the next stirrup 12 are rigidly fastened to drum body 5, as in FIG. 11.

Figure 12:
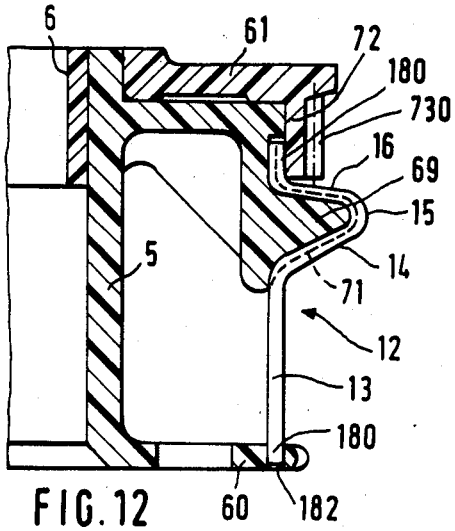

The embodiment according to FIG. 12 is also similar to that in FIGS. 8 to 11, except that the design of stirrups 12 is simpler. Each stirrup 12 is essentially U-shaped only in the section formed by its first leg 16, the bend 15 and the inwardly slanted section 14. The angled fastening element 180 that follows leg 16 is coaxial to the part that forms yarn contact section 14 which follows the above section and is fastened to an associated aperture 182 of the lower ring flange 60. The diameter of aperture 182 can, as shown in FIG. 12, be equal to the diameter of the associated wire stirrup 12, as the result of which stirrup 12 is rigidly fastened at both ends.

As an alternative the arrangement can also be designed in such a way that every or every second aperture has a diameter that is greater than that of the wire stirrups 12, as shown in FIG. 8. This would have the result that the elastic stirrups 12 are guided at their lower ends with limited radial movability.

Above the yarn contact section 13 the stirrups 12 lie on a rib-like part 69 of drum body 5 that surrounds it and carries for each stirrup 12 a groove 71 with an open edge in which the associated stirrup 12 is laterally guided. The upper fastening elements 180 of stirrups 12 are fastened between the above mentioned rib-like part 69 and a cylindrival flange 72 forming part of ring flange 61. Flange 72 overlaps the fasteneing elements 180 of stirrups 12 in a manner shown in FIG. 12. Outside on the cylindrical flange 72 is are moulded gear teeth 730 into which a toothed belt can engage that is not described in detail.

Figure 13:
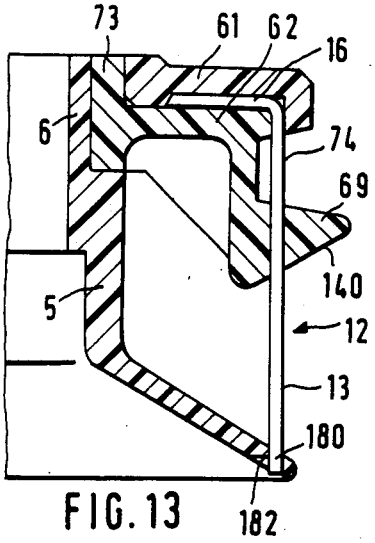

An embodiment with an even simpler design of stirrups 12 is shown in FIG. 13. The wire stirrups 12 are in L-shape in this case, and their first legs 16 lie on the contact surface 62 of drum body 5 that runs at a right angle to the rotational axis of the drum or—as shown—of a part moulded thereto. They are held by the attached ring washer 61; if necessary either ring washer 61 or the section of contact surface 62 can be designed with lateral guide ribs for the first stirrup legs 16.

With their legs that form the straight yarn contact sections 13, the stirrups 12 penetrate the rib-like section 69 which with its—if required—wear-resistant cone surface 140 forms the tapered section of the storage drum; the tapered section tapers radially inward toward the yarn unwind side and is comparable to section 14 shown in FIG. 8. Cone surface 140 can also be interrupted by grooves, and furthermore it is conceivable to subdivide the entire rib-like section 69 into radial planes by means of slots, so that it consists of independent, congruent rigs that lie side by side with distance between them.

The fastening elements 180 at the ends of stirrups 12 are fastened in cylindrical apertures 182 of drum body 5; the diameter of apertures 182 is either the same as or larger than the wire diameter, as has been explained above in terms of the other embodiments.

Above the bulge-like section 69, the stirrups lie freely in a section 74 that forms a pin wheel or lantern gear into which a toothed drive belt can engage, the belt not being described in detail.

Figure 14:
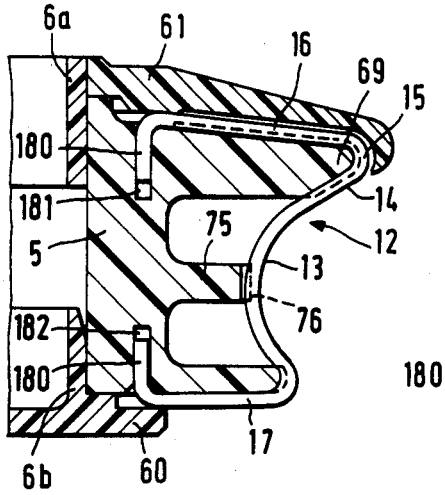
Figure 15:
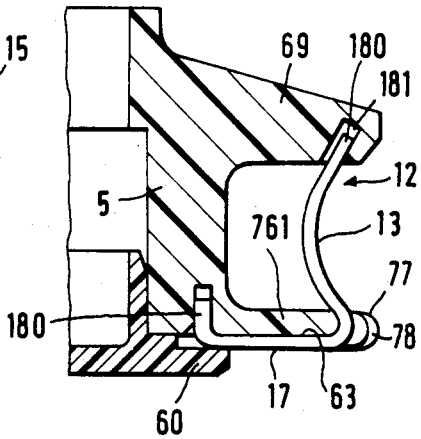
Figure 16:
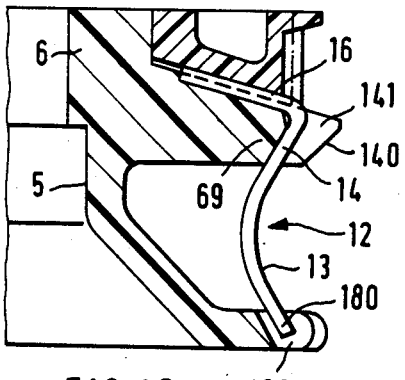

FIGS. 14–16 show embodiments in which yarn contact section 13 is not straight but concavely curved with respect to the outside of the storage drum. The curvature of the stirrups 12 is even throughout the entire yarn contact section which also includes the inwardly tapered section 14 according to the embodiment shown in FIG. 8. The advantage compared with known storage drums made of solid construction and generally designed in the manner of a capstan is that stirrups 12 are touching the yarn windings only at a point, and that the winding body is polygonal. Thus the risk that the yarn will stick to the storage drum is reduced to a minimum. Since the stirrups 12 are shaped in a very simple fashion from a hard, elastic material, no surface treatment is required to increase wear resistance as is the case with storage drums of solid construction in the yarn feeding, delivery and contact sections. Apart from the curved design of the yarn contact section 13, the embodiment according to FIG. 14 corresponds to that shown in FIG. 11, so that no further explanation is necessary. Both ends of the stirrups 12 are rigidly fastened to the drum body 5; they are also radially supported approximately in the middle of the yarn contact section 13 by means of a support disk 75 that is moulded to the drum body 5 and carries grooves 76 at its outer circumference. The grooves 76 have open edges, in which the stirrups 12 are laterally guided. The upper ring disk 61 is broadened like a lid, so that it covers the entire length of the first legs of stirrups 12 and even covers most of arc 15 of each stirrup 12.

In this embodiment, too, the stirrups 12 could be guided in apertures 180 to provide them with limited radial movement in the area of their lower fastening elements 180, as shown in FIG. 8.

It is furthermore conceivable to simply fasten the stirrups 12 in the area of their lower second legs 17 to drum body 5 and to give them limited radial movement in the area of their upper first leg 16, for example by designing the apertures 181 with a diameter that is greater than that of the associated fastening elements 180 and to arrange the ring disk 61 at a distance from the first stirrup legs 16.

FIGS. 15 and 16 show embodiments with stirrups 12 that are guided at one end in such a way that they have limited radial movement.

In the embodiment according to FIG. 15, the essentially L-shaped stirrups 12 are—similarly to FIG. 14—rigidly fastened by their second legs 17 and their fastening elements 180 to drum body 5; in the area of the lower contact surface 63 each stirrup leg 17 can be designed with a groove that is open at the edge and serves to guide this stirrup leg laterally. The lower contact surface 63 is formed by means of a disk-shaped moulded element 761 of drum body 5 which protrudes radially by means of a bulge-like part 77 beyond he stirrups and thus forms the yarn back-winding border. The bulge-like part 77 can have a notch 78 in th area of each stirrup 12, so that the result is an arrangement that can be compared with the lower deflector ring 66 in FIG. 8.

With its upper fastening element 180 each stirrup 12 engages in an associated aperture 181 of the surrounding buldge-like part 69 of drum body 5. The diameter of each aperture 181 is greater than the diameter of the associated stirrup 12.

In the embodiment according to FIG. 16, the stirrups 12 on the yarn feeding side are in principle fastened similarly to those in the embodiment shown in FIG. 13, namely by their first stirrup legs 16, so that no additional explanation is necessary in this case either. The bulge-like section 69 of drum body 5 protrudes radially beyond stirrups 12 in the area of its inwardly slanted inclined circumferential surface 140; it is designed with longitudinal slots 141 in which the stirrups 12 can move radially but are guided laterally. The fastening elements 182 of stirrups 12 engage in apertures 182 of drum body 5; the diameter of these apertures is greater than the diameter of the wire stirrups 12.

Figure 17:
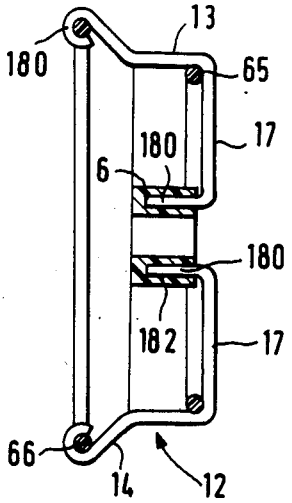

FIG. 17 shows a particularly simple embodiment of a storage drum 4 that is characterized by a very small inert mass. The fastening elements 180 of the second legs 17 of the essentially U-shaped wire stirrups 12 are inserted directly into associated apertures 182 which have the same diameter as drum body 5 that is reduced to hub 6. On the other end their fastening elements 180 are wrapped around and connected with a yarn deflector ring that is made of wire and also serves as support ring. The other yarn deflector ring 65 is also made of wire and fastened in the same manner to stirrups 12 at their second legs 17. If necessary, the stirrups 12 can also be designed with a bulb-like section 41.

Figure 18:
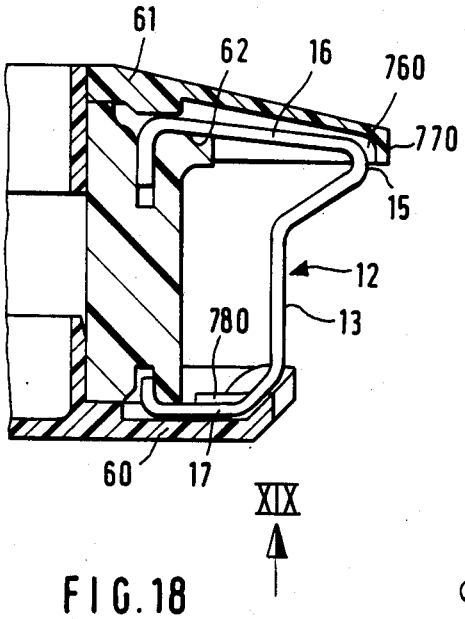
Figure 19:
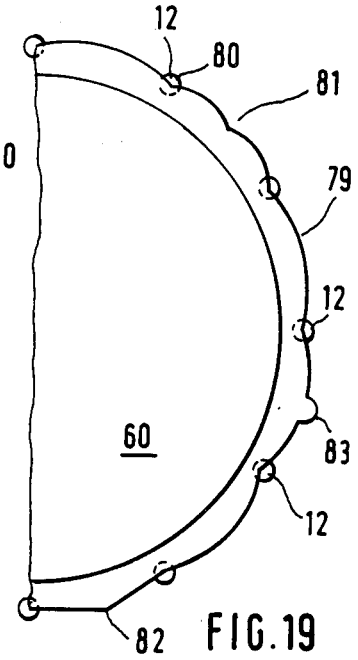
FIG. 19 shows the storage drum according to FIG. 18 seen in a plan view of its underside in direction of arrow XIX in FIG. 18.
Figure 20:
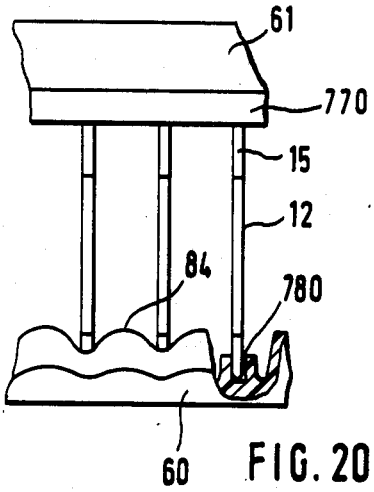
FIG. 20 shows the storage drum according to FIG. 18 seen in a sideview, in section and partially cut away.

FIGS. 18 to 20 shows an embodiment that is similar to that shown in FIGS. 8 to 10, and reference is made to the explanation for the latter.

In deviation from the embodiment according to FIGS. 8 to 10, the stirrups 12 made of elastic wire are not supported radially in yarn contact section 13. The upper contact surface 62 of their first legs 16 is designed with a small diameter 20 that the spring action can be exerted over a greater area of stirrups 12. For the lateral guidance of stirrups 12 the inside of the upper ring disk 61 that has been radially enlarged similarly to FIG. 14 is designed with grooves 760 into which engage stirrups 12 in the area of their arcs 15 and the ends of their first legs 16. Ring disk 61 radially overlaps the stirrups 12; its outer border 770 that partly covers arcs 15 also acts a yarn deflector, thus promoting good yarn feeding. Furthermore this measure offers protection against flying fibers from above.

The lower ring flange 60 also radially protrudes beyond the straight yarn contact section 13 of stirrups 12. Its outside is shell-like, and its inside has grooves 780 in which the stirrups are laterally guided in such a way that the stirrups 12 remain freely movable radially. The yarn contact section of each stirrup 12 is diagonally bent where the second leg 17 begins, as FIG. 18 shows. Furthermore, outwardly protruding bulges 79 are moulded to the outer circumferential surface of ring flange 60 in a manner that is shown particularly clearly in FIG. 19; these bulges extend between the stirrups 12 in garland fashion. The yarn contact sections of stirrups 12 remain about half uncovered, as is indicated at number 80 in FIG. 19. The bulges can either run between two neighboring stirrups 12 in the manner of an outwardly convex circular arc or—as indicated at number 81—formed between two neighboring stirrups 12 by two convex radii with an intermediate notch. It is also possible to conceive embodiments where the bulges are bordered by straight chords, as indicated at number 82. Alternatively, or additionally the design could call for separate tooth or finger-like protrusions 83 arranged in the region between neighboring stirrups 12.

To prevent yarn loops from getting between the stirrups 12 and the ring disk 68 in the region of bulges 79 (see FIG. 20), it is desirable for the bulges 79 to be placed in axial direction higher than the slanted bend of yarn contact sections 13, as shown at 84 where the latter become the second stirrup legs 17.

Figure 21:
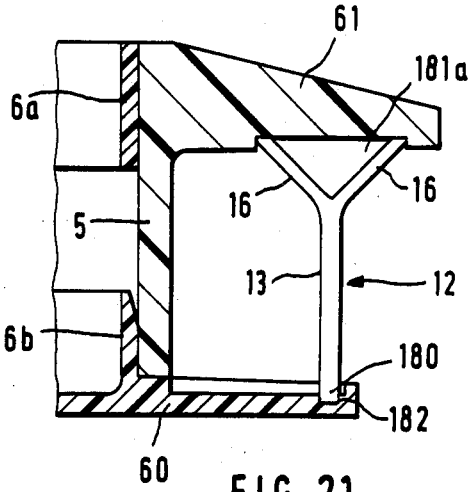
FIG. 21 shows the storage drum of the yarn delivery and storage arrangement according to FIG. 2 in a further modified embodiment in axial section, seen in side view and in a partial presentation.

FIG. 21 finally shows an embodiment in which the essentially L-shaped stirrups are designed with first legs 16 that divide in Y-fashion and that are fastened in an associated aperture 181*a* in the upper ring flange 61 in a radial plane to the drum axis. Following the straight yarn contact section 13, each stirrup 12 is inserted on the opposite side into an associated aperture 182 of the lower ring flange 60 with its fastening element 180.

In this embodiment the stirrups 12 can also be designed as sleeves or turned parts, so that the two first stirrup legs 16 are formed by a moulded cone.

We claim:

1. A yarn storage and feeding apparatus, particularly for textile machines, comprising a rotatable storage drum (4) defining an axis of rotation (11);

a drum body (5) coaxial with the rotational axis (11) of said storage drum, a plurality of elongaged yarn support members (12), arranged at equal radial distances from said axis (11) and evenly distributed around said axis, said yarn support members being oriented in the general direction of said axis and defining a yarn storage section or portion (13) adapted to support, on the storage section, a number of adjacent yarn turns or loops to form a storage winding;

yarn feeding or supply guide means (23) and yarn delivery guide means (24), respectively located at a yarn feeding side and a yarn delivery side of said storage drum and adapted to guide yarn to and from said storage drum, drive means (8, 47) coupled to the storage drum (4) for imparting a rotational motion to said storage drum with respect to said yarn feeding and yarn delivery elements, wherein each of said yarn support members (12) comprises a narrow low-inertia bracket or bail of general L or U shape, defining at least one leg (16,17) at one of its ends and a radially inwardly directed or slanted yarn receiving section (14), onto which receiving section yarn is fed from said yarn feeding guide means said yarn receiving section being adjacent to said yarn storage section (13), wherein each of said L or U-shaped yarn support members (12) is fixedly attached to said drum body (5) by at least one of said at least one legs (16, 17); and wherein the yarn receiving sections (14) and the yarn storage sections (13) of said support members (12) are all located on a common imaginary or theoretical common body of revolution coaxial with said rotational axis (11).

2. The apparatus of claim 1, wherein at least the yarn storage section (13) of the yarn support members is concavely curved toward said axis (11).

3. The apparatus of claim 1, wherein the yarn storage section (13) of said yarn support members is essentially straight.

4. The apparatus of claim 1, wherein the yarn support members (12) are guided for limited radial movement on said drum body (5); and wherein said yarn support members are at least partly elastic.

5. The apparatus of claim 1, wherein said at least one leg (16) of the yarn support members (12) extends essentially radially with respect to the drum body (5).

6. The apparatus of claim 1, including guide means (69) coupled to said body (5) and guiding the at least one leg (16) of the yarn support members (12) in the region where said yarn support members are attached to the drum body.

7. The apparatus of claim 1, wherein the at least one leg (16) has a bent-over end portion (180) extending at an angle with respect to the remainder of said at least one leg (16), and means formed in said body (5, 61, 69) receiving and retaining said bent-over end portion (180).

8. The apparatus of claim 1, wherein the yarn support members (12) are generally U-shaped and have two legs (16, 17) extending essentially radially with respect to the drum body (5, 34, 60, 76); and means formed on the drum body (5, 34, 60, 76) for guiding the second leg (17) on the drum body.

9. The apparatus of claim 8, including cooperating guide means formed on the second leg (17) for lateral guidance of the yarn support member on the drum body (5; 34, 60, 76).

10. The apparatus of claim 1, wherein the drum body (5, 61, 69) is formed with slots (18, 141), the at least one leg (16, 17) of the yarn support members (12) being, at least in part, retained in said slots, said slots forming guide means for the yarn support members.

11. The apparatus of claim 10, wherein the yarn body (5) is essentially pot or cup-shaped, and defines a face end wall;

and the slots (18) defining the guide means are formed at least in the region of the face end wall.

12. The apparatus of claim 1, wherein the yarn support members (12) are generally U-shaped and comprise two legs (16, 17);

wherein each one of the legs (16, 17) terminates in a bent-over end portion (180); and the drum body (5) is formed with receiving openings for both said bent-over end portions to retain the yarn support members (12) on the yarn body.

13. The apparatus of claim 12, wherein the openings (181, 182) formed in the yarn body to receive the bent-over end portions (180) of the legs (16, 17) of the yarn support members (12) are coaxial with respect to each other.

14. The apparatus of claim 13, wherein at least one of the openings (182) receiving a respective end portion of one of the legs (17) is larger than said end portion of the leg being received therein to permit lateral play and resilient deflection of the yarn support members (12).

15. The apparatus of claim 1, wherein the yarn support members (12) are generally U-shaped and comprise two legs (16, 17);

wherein the drum body (5) is formed with an engagement surface (21; 62, 63) engaging a portion of the elongated yarn support members (12) in axial direction with respect to the drum;

and wherein the yarn support members (12) are elastic elements and elastically retained on the drum body with prestressed tension.

16. The apparatus of claim 1, wherein the yarn support members (12) are generally U-shaped and comprise two legs (16, 17);

wherein the drum body (5) is formed with an engagement surface (21; 62, 63) engaging a portion of the elongated yarn support members (12) in radial direction with respect to the drum;

and wherein the yarn support members (12) are elastic elements and elastically retained on the drum body with prestressed tension.

17. The apparatus of claim 1, wherein the yarn support members (12) are elastic, both ends of said elongated yarn support members being retained on the drum body, with pre-stressed tension with respect to radial direction thereof.

18. The apparatus of claim 17, wherein the end portion of the elongated yarn support members (12) which is not fixedly attached to the drum body (5) is retained thereon while permitting radially limited movement, and the yarn storage sections (13) of the elongated yarn support members (12) define a circular cone which is coaxial with respect to the drum axis (11).

19. The apparatus of claim 16, wherein the drum body (5) includes a disk or star-shaped support element (34) engaged by the yarn support members (12).

20. The apparatus of claim 19, wherein the support element (34) is formed with an outer circumferential bulge (35).

21. The apparatus of claim 19, wherein the support element (34) includes a yarn run-off ring (37) having a surface of wear-resistant material, and secured to the support element (34).

22. The apparatus of claim 21, wherein at least one of said legs (16, 17) is formed with a bent-off attachment end portion (52);

and the drum body (5) includes a support element (52) engageable with and supporting said bent off end portion.

23. The apparatus of claim 1, wherein the yarn support members (12) are generally U-shaped and comprise two legs (16, 17);

and a cover element (22; 60, 61) secured to the drum body and retaining at least one of said legs (16, 17) on the drum body.

24. The apparatus of claim 1, wherein the yarn storage section or portion (13) of the elongated yarn support members is formed with a radially projecting ribbed or bulged separating projection (40) located intermediate the yarn storage section or portion (13) to separate the yarn storage section or portion into two subsections or portions (13*a*, 13*b*).

25. The apparatus of claim 1, wherein the yarn support members (12) include a radially outwardly directed region (41) located close to the yarn run-off portion or zone of the yarn storage section (13), said radially outwardly directed regions (41) of all the yarn support members being positioned on a theoretical rotational surface.

26. The apparatus of claim 1, wherein a yarn guide ring (65,66) is provided, retained on the elongated yarn support members (12) and positioned coaxially with respect to the axis of rotation (11) of the drum (5).

27. The apparatus of claim 26, wherein the elongated yarn support members (12) are formed with a bulged portion adjacent at least one end zone of the yarn storage section (13), said bulged portion being bulged outwardly and retaining the yarn guide ring (65, 66) therein.

28. The apparatus of claim 26, wherein the yarn support members (12) are generally U-shaped and comprise two legs (16, 17);

and wherein two yarn guide rings (65, 66) are provided, one each being located adjacent the portion of the respective leg (16, 17) which leads to the yarn storage section or portion (13).

29. The apparatus of claim 26, wherein the yarn guide ring (65, 66) is formed with interengaging means (67) engaging the yarn support members (12) to provide for lateral guidance of the yarn support members.

30. The apparatus of claim 1, wherein the drum body (5) comprises a thin-walled, essentially pot-shaped plastic structure.

31. The apparatus of claim 30, wherein the drum body (5) is formed with apertured slits (29) in regions between the elongated yarn support members.

32. The apparatus of claim 1, wherein the elongated yarn support members are shaped, thin spring wire elements.

33. The apparatus of claim 1, further including fan blade elements (38, 42) carried by the elongated yarn support members.

34. The apparatus of claim 1, wherein the yarn support member (12) comprise flat sheet elements which are formed with fan blade portions (42) positioned in the region of the yarn storage sections (13).

35. The apparatus of claim 1, wherein the elongated yarn support members (12) are located in planes with respect to a theoretical body of rotation coaxial with the axis (11) of the drum.

36. The apparatus of claim 1, wherein circumferentially alternate yarn support members (12) are fixedly attached to said drum body at respectively one leg and another end portion of the yarn support member;

and wherein those of said yarn support members which are fixedly attached to the drum body with only one leg have the other end portion laterally or radially guided on said drum body (5).

37. The apparatus of claim 1, further including a support (1, 2);

a yarn guide element (43) secured to said support and located in fixed position with respect to the rotatable storage drum (4) and extending just up to a theoretical circular cone defined upon rotation of the drum body by the slanted yarn receiving section (14) of the elongated yarn support members (12).

38. The apparatus of claim 37, wherein the yarn guide element (43) is formed with an essentially convex yarn deflection edge or surface (44, 46) located laterally with respect to the rotatable storage drum.

39. The apparatus of claim 1, wherein the elongated yarn support members (12) comprise wire elements.

40. A yarn storage and feeding apparatus, particularly for textile machines, comprising a rotatable storage drum (4) defining an axis of rotation (11);

a drum body (5) coaxial with the rotational axis (11) of said storage drum, a plurality of elongaged yarn support members (12), arranged at equal radial distances from said axis

(11) and evenly distributed around said axis, said yarn support members being oriented in the general direction of said axis and defining a yarn storage section or portion (13) adapted to support on the storage section a number of adjacent yarn turns or loops to form a storage winding;

yarn feeding or supply guide means (23) and yarn delivery guide means (24), respectively located at a yarn feeding side and a yarn delivery side of said storage drum and adapted to guide yarn to and from said storage drum, drive means (8, 47) coupled to the storage drum (4) for imparting a rotational motion to said storage drum with respect to said yarn feeding and yarn delivery elements, wherein each of said yarn support members comprises a narrow low-inertia bracket or bail of general L or U shape defining at least one leg (16, 17) at one of its ends, and a generally axially extending portion which includes said yarn storage section or portion;

wherein eac of said L or U-shaped yarn support members (12) is fixedly attached to said drum body (5) by at least one of said at least one legs (16, 17);

wherein the yarn storage section or portion (13) of said support members are all located on a common imaginary or theoretical body of revolution coaxial with said axis (11);

and wherein the drum body (5) includes a radially extending portion (69) projecting between the yarn support members (12) in the region of the yarn storage section or portion (13) and defining, adjacent said yarn storage section or portion, a yarn receiving region, said radially extending portion (69) being formed with a radially inwardly directed or slanted surface (140), said yarn feeding element directing yarn to said yarn receiving section.

41. A yarn storage and feeding apparatus, particularly for textile machines, comprising a rotatable storage drum (4) defining an axis of rotation (11);

a drum body (5) coaxial with the rotational axis (11) of said storage drum, a plurality of elongaged yarn support members (12), arranged at equal radial distances from said axis (11) and evenly distributed around said axis, said yarn support members being oriented in the general direction of said axis and defining a yarn storage section or portion (13) adapted to support on the storage section a number of adjacent yarn turns or loops to form a storage winding;

yarn feeding or supply guide means (23) and yarn delivery guide means (24), respectively located at a yarn feeding side and a yarn delivery side of said storage drum and adapted to guide yarn to and from said storage drum, drive means (8, 47) coupled to the storage drum (4) for imparting a rotational motion to said storage drum with respect to said yarn feeding and yarn delivery elements, wherein each of said yarn support members (12) comprises a narrow low-inertia resilient spring element defining, at one end portion, a clamping or holding extension (180);

means (61, 72, 730) coupled to said drum body for clamping said clamping extension (180) into said drum body;

means (60, 182) for retaining the other end portion of said elongated yarn support member (12) for radially deflectable movement on said drum body;

wherein the yarn storage sections or portions (13) of all said support members (12) are all located on a common imaginary or theoretical body of revolution coaxial with said axis, and resilient deflectable to form, selectively and under tension of yarn being wound about said support members, a conical body of revolution;

and means (14, 15; 69) adjacent said projecting clamped portion (180) forming a radially inwardly directed or slanting yarn receiving section (14, 140) located adjacent to the yarn storage section or portion (13) of the yarn support member, the yarn feeding element directing yarn to said yarn receiving a portion or portion (13).

* * * * *